US008087904B2

(12) United States Patent
Best

(10) Patent No.: US 8,087,904 B2
(45) Date of Patent: Jan. 3, 2012

(54) HYBRID HYDRAULIC-ELECTRIC RAM PUMPING UNIT WITH DOWNSTROKE ENERGY RECOVERY

(75) Inventor: Larry D. Best, Springtown, TX (US)

(73) Assignee: Global Oilfield Services LLC, Houston, TX (US)

( * ) Notice: Subject to any disclaimer, the term of this patent is extended or adjusted under 35 U.S.C. 154(b) by 531 days.

(21) Appl. No.: 12/192,022

(22) Filed: Aug. 14, 2008

(65) Prior Publication Data

US 2009/0047153 A1 Feb. 19, 2009

Related U.S. Application Data

(60) Provisional application No. 60/964,896, filed on Aug. 15, 2007.

(51) Int. Cl.
*F04B 49/00* (2006.01)
*F04B 9/10* (2006.01)
*F01B 3/02* (2006.01)

(52) U.S. Cl. ..... 417/271; 417/53; 417/237; 417/375; 417/904; 60/371; 166/67; 92/12.2

(58) Field of Classification Search ..... 417/415, 417/375, 904, 53, 390, 237, 271; 60/413, 60/414, 371; 166/68.5, 67; 92/12.2
See application file for complete search history.

(56) References Cited

U.S. PATENT DOCUMENTS 2,276,358 A * 3/1942 Vickers ..... 290/7
4,724,672 A * 2/1988 Olmsted ..... 60/371
5,097,901 A 3/1992 Klaeger
5,251,536 A * 10/1993 Engel ..... 91/506
5,295,796 A * 3/1994 Goto et al. ..... 417/222.1
5,564,905 A * 10/1996 Manring ..... 417/222.1
5,743,716 A * 4/1998 Smith ..... 417/46
5,827,051 A * 10/1998 Smith ..... 417/375
7,810,331 B2 * 10/2010 Jones ..... 60/641.2
2004/0112586 A1 6/2004 Matthews et al.
2005/0022997 A1 2/2005 Hardgrave
2006/0266513 A1 11/2006 Tips

FOREIGN PATENT DOCUMENTS

CA 02490846 A1 5/2006

OTHER PUBLICATIONS

International Search Report, dated Jan. 7, 2009.
International Preliminary Report on Patentability for PCT/US2008/073325, 5 pages, issued Feb. 25, 2010.

* cited by examiner

*Primary Examiner* — Charles Freay
*Assistant Examiner* — Nathan Zollinger
(74) *Attorney, Agent, or Firm* — Baker Botts L.L.P.

(57) ABSTRACT

A hybrid hydraulic-electric pumping unit (12) with downstroke energy recovery is disclosed which is operated in a conventional flow mode to supply hydraulic fluid to a hydraulic ram (26), and then is operated in a reverse flow mode to receive the hydraulic fluid from the hydraulic ram (26) and turn an electric motor (16) to generate electric power. A single hydraulic hose (48) connects the pump (18) to the hydraulic ram (26), and is used for both passing the hydraulic fluid from the pump (18) to the hydraulic ram (26) and from the ram (26) to the pump (18). The potential energy of the weight of sucker rods (10) lifted in operating the pumping unit (12) is recovered by operating the pump (18) and motor (16) with return of the hydraulic fluid from the hydraulic ram (26) through the pump (18), which turns the motor (16) to generate electric power.

20 Claims, 2 Drawing Sheets

HYBRID HYDRAULIC-ELECTRIC RAM PUMPING UNIT WITH DOWNSTROKE ENERGY RECOVERY

CROSS-REFERENCE TO RELATED APPLICATION

The present application is a continuation application of U.S. Provisional Application Ser. No. 60/964,896, filed Aug. 15, 2007, entitled "Hydraulic Pumping Unit and RAM With Down Stroke Energy Recover," and invented by Larry D. Best.

TECHNICAL FIELD OF THE INVENTION

The present invention relates in general to pump units for oil wells, and in particular to a pumping unit for recovering energy expended for pumping operations

BACKGROUND OF THE INVENTION

Hydraulic pumping units have been provided for pumping fluids from subterranean wells, such as oil wells. The pumping units have hydraulic power units and controls for the hydraulic power units. The hydraulic power units usually have an electric motor which powers a positive displacement pump to force hydraulic fluid into a hydraulic ram. The ram is stroked to an extended position to lift sucker rods within a well and provide a pump stroke. The ram lifts the weight of the sucker rods and the weight of the well fluids being lifted with the sucker rods. When the ram reaches the top of the pump stroke, the hydraulic fluid is released from within the ram at a controlled rate to lower the weight of the sucker rods into a downward position, ready for a subsequent pump stroke. The hydraulic fluid is released from the ram and returns to a fluid reservoir. Potential energy of the weight of the lifted sucker rods is released and not recovered when the hydraulic fluid is released from within the ram and returns directly to the fluid reservoir without being used to perform work.

SUMMARY OF THE INVENTION

A hybrid hydraulic-electric ram pumping unit is disclosed which provides for downstroke energy recovery. A variable displacement, positive displacement pump is driven by an electric motor to supply pressurized hydraulic fluid to a hydraulic ram, which telescopically moves the ram into an extended position. Moving the hydraulic ram into the extended position lifts a sucker rod assembly from a downward position to a lifted position, to lift fluid within the well. Once the hydraulic ram is disposed in the extended position, the hydraulic fluid is released from the ram to lower the sucker rod assembly back into the downward position, which releases the potential energy provided by the weight of the sucker rod assembly when disposed in the lifted position. The variable displacement, positive displacement, hydraulic pump is modified for operating in a reverse flow direction, such that the hydraulic fluid may pass from the hydraulic ram, back into the pump discharge port, through the pump, through the pump suction port and into a fluid reservoir with the drive shaft for the hydraulic pump and the rotor for the electric motor turning in the same angular direction as that for pumping the hydraulic fluid into the ram. Reversing the flow direction of the hydraulic fluid through the pump uses the pump as a hydraulic motor which provides power for turning the electric motor at a rate which is above synchronous speeds. When the electric motor is turned at a greater rate than synchronous speeds, current is generated for applying to an electric power meter and returning electric power to the power grid from which energy to operate the electric motor and the hydraulic pump was initially drawn. A single hydraulic hose connects the outlet of the pump to the hydraulic ram, with the single hydraulic hose used both for supply of the hydraulic fluid from the pump to the ram and for return of the hydraulic fluid from the ram, through the pump and to a hydraulic fluid reservoir. The potential energy stored by lifting the weight of the sucker rod assembly during the ram up stroke is recovered by passing the hydraulic fluid from the ram and through the pump in the reverse flow direction.

DESCRIPTION OF THE DRAWINGS

For a more complete understanding of the present invention and the advantages thereof, reference is now made to the following description taken in conjunction with the accompanying Drawings in which

FIG. 1 is a schematic diagram depicting a side elevation view of the hybrid hydraulic-electric ram pump having downstroke energy recovery;

FIG. 2 is a longitudinal section view of a variable volume piston pump which is operable in both conventional flow and reverse flow directions with the motor shaft continuously moving in the direction for pumping fluid; and FIG. 3 is a one-quarter longitudinal section view of an upper portion of the cylinder and the piston rod for the hydraulic ram, showing a rod bearing and seal assembly and an indicator device for monitoring seal wear on the rod bearing and seal assembly for the hydraulic ram.

DETAILED DESCRIPTION OF THE INVENTION

Figure 1:
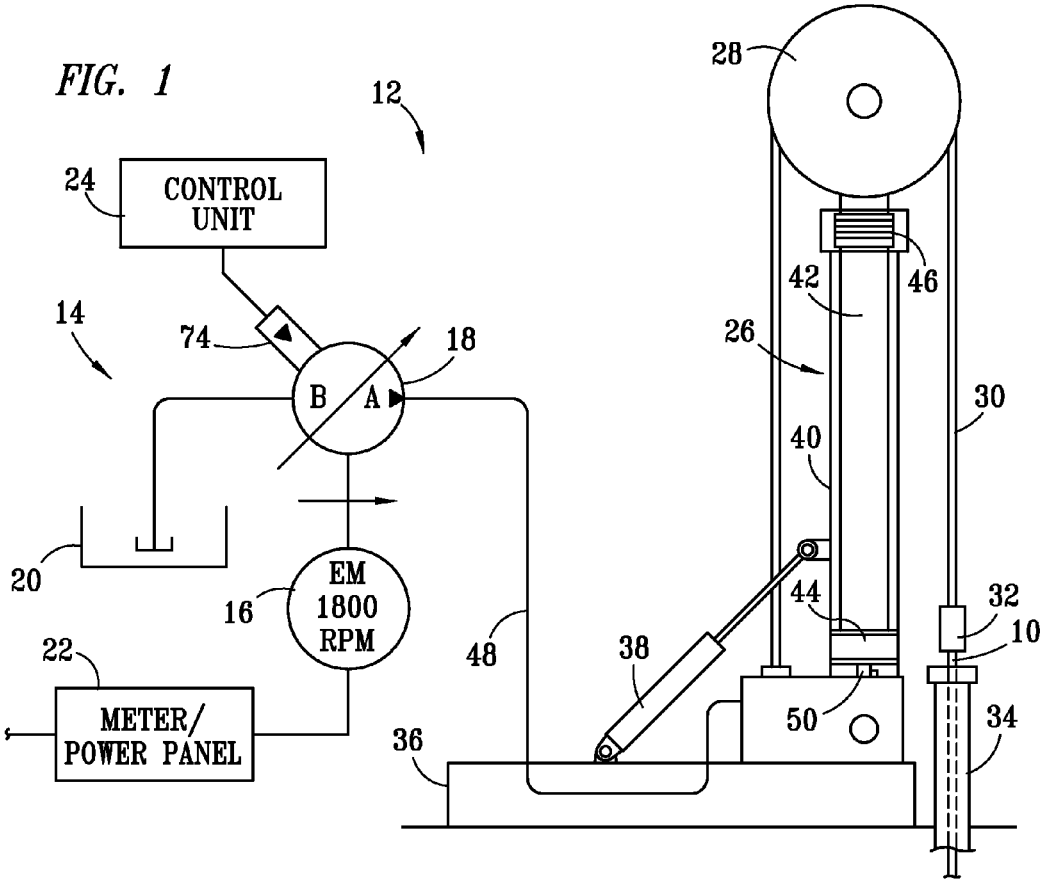
FIGS. 1 through 3 show various aspects for a hybrid hydraulic-electric ram pumping unit having downstroke energy recovery devices made according to the present invention, as set forth below.

FIG. 1 is a schematic diagram depicting a side elevation view of the hybrid hydraulic-electric ram pumping unit 12 having downstroke energy recover according to the present invention. The ram pumping unit 12 is preferably a long stroke type pumping unit with heavy lift capabilities. The hybrid hydraulic-electric ram pumping unit 12 preferably has a single acting hydraulic ram 26, a traveling block 28, a nylon belt 30, a carrier bar 32, a sucker rod assembly 10, and a hydraulic power unit 14. The only hydraulic connection between the power unit 14 and the ram 26 is a single high pressure hose 48. The hydraulic power unit 14 includes an AC electric motor 16, a variable volume piston pump 18, a fluid reservoir 20, a power meter 22, and a control unit 24. The control unit 24 preferably includes a motor control center and a microprocessor based variable speed pump down system. The pump down system monitors the polished rod load and position to make appropriate speed adjustments to optimize production from the well while keeping operational costs at a minimum. The electric motor 16 is connected to the power meter 22, which is preferably a bidirectional electric meter which connects between a power grid and the electric motor 16 for both supplying electric power to the motor 18 and transferring electric power from the motor 18 to the power grid.

The traveling block 28 and belt 30 doubles the sucker rod stroke relative to the ram stroke. Stroke lengths up to 360 inches are available. The ram 26 is mounted on a heavy structural base 36 that stands over the well head 34 and attaches to the polished rod with a carrier bar. The hydraulic ram 26 includes a piston rod 42 disposed within a cylinder 40. A sleeve bearing provides a rod guide bearing 44 which is located at the lower end of the piston rod 42, and engages the inside wall of the cylinder 40. A rod bearing and packing assembly 46 is located at the upper end of the cylinder 40. The ram 26 and traveling block 16 can be raised and lowered with a hydraulic cylinder 38 for shipment, installation or work over. An integrally mounted linear position sensor 50 is preferably provided by a Temposonics® brand sensor available from MTS Systems Corporation, of Eden Prairie, Minn. The linear position sensor 50 provides feedback signals to the control unit 24 for determining the position of the piston rod 42 in the cylinder 40. The position sensor 50 preferably includes an integral velocity fuse for preventing runaway rod fall and oil leakage in case of a flow line failure.

A control unit 24 and a pump control unit 74 are provided for controlling operation of the pump 18 and the ram pumping unit 12. The control unit 24 is preferably a microprocessor-based controller which is provided sensor inputs for the stroke position of the piston rod 42 of the ram 26, and the polished rod load. The polished rod load provides a measured weight of the sucker rods 10 at the wellhead 34. The control unit 24 will feed a control signal to the pump control unit 74, to vary the flow rate through the pump 18. The pump control unit 74 is an integral pump controller which is preferably provided by a microprocessor-based unit that is mounted directly to the pump 18, such as such a Model 04EH Proportional Electro-hydraulic Pressure and Flow Control available from Yuken Kogyo Co., Ltd. of Kanagawa, Japan, the manufacturer of the pump 18 of the preferred embodiment. The Yuken Model 04EH pump controller includes a swash plate angle sensor and a pump pressure sensor, and provides control of the swash plate angle C and D (shown in FIG. 2) to control the pressure output and the flow rate of the hydraulic fluid through the pump 18.

Figure 2:
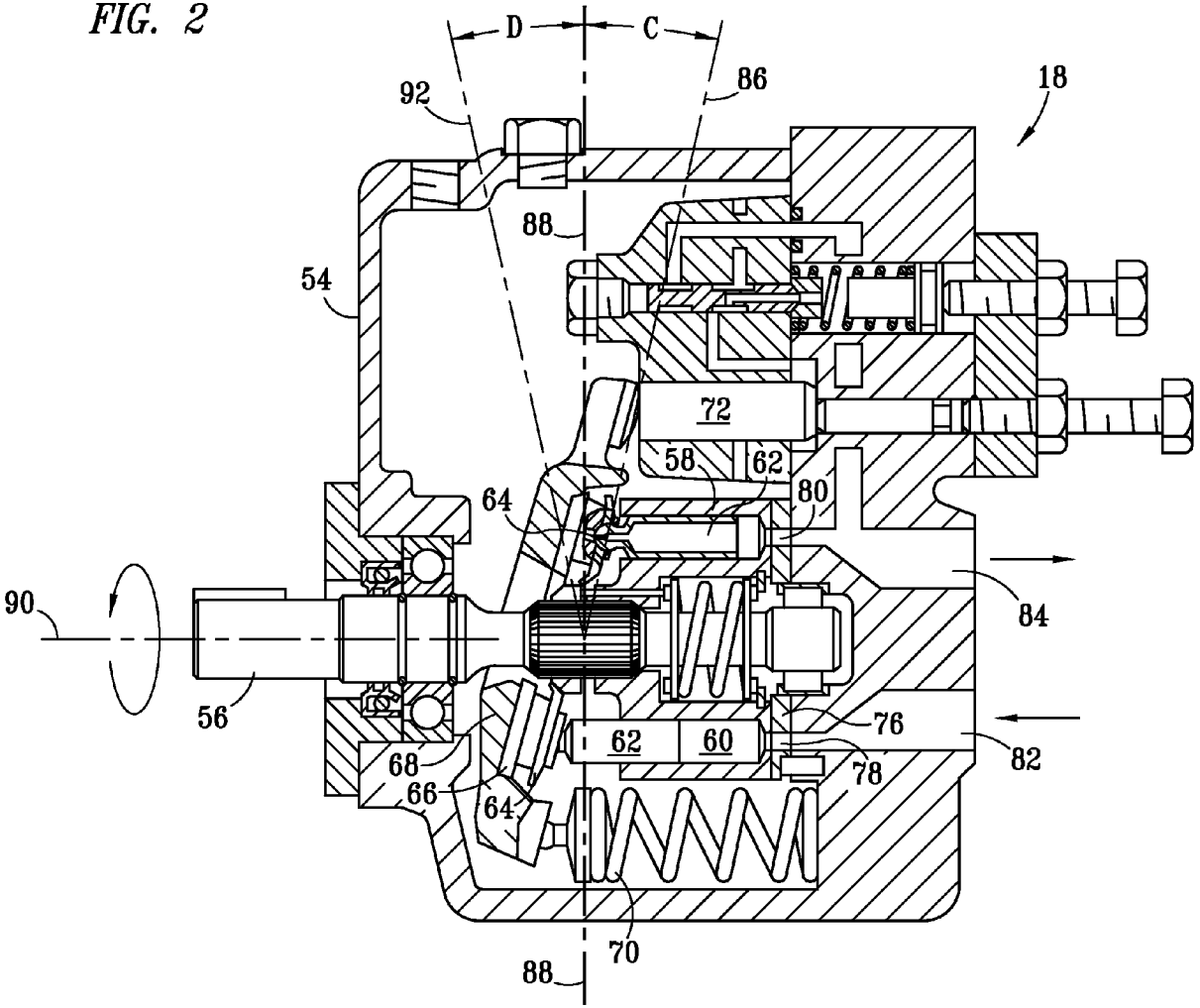

FIG. 2 is a longitudinal section view of the variable volume piston pump 18 which is operable in both a conventional flow direction mode and a reverse flow direction mode, with a drive shaft 56 of the pump 18 and the rotor of the electric motor 16 continuously turning in the same angular direction for both flow directions. The pump 18 has a pump housing 54 within which is the drive shaft 56 is rotatably mounted. The pump drive shaft 56 is connected to the rotor of the electric drive motor 16 (shown in FIG. 1), in conventional fashion. A cylinder block 58 is mounted to the drive shaft 56, in fixed relation to the drive shaft 54 for rotating with the drive shaft 56. Preferably, a portion of the outer surface of the drive shaft 56 is splined for mating with splines in an interior bore of the cylinder block 58 to secure the drive shaft 56 and the cylinder block 58 in fixed relation. The cylinder block 58 has an inward end and an outward end. The inward end of the cylinder block 58 has a plurality of cylinders 60 formed therein, preferably aligned to extend in parallel, and spaced equal distances around and parallel to a centrally disposed, longitudinal axis 90 of the drive shaft 56. The drive shaft 56 and the cylinder block 58 rotate about the axis 90. Pistons 62 are slidably mounted within respective ones of the cylinders 60, and have outer ends which are disposed outward from the cylinders for engaging retainers 62. The retainers 62 secure the outer ends of the pistons 62 against the surface of a swash plate 66. The outward end of the cylinder block 58 is ported with fluid flow ports for passing hydraulic fluid from within the cylinders 60, through the outward end of the cylinder block 58. A port plate 76 is mounted in fixed relation within the pump housing 54, and engages the outward, ported end of the cylinder block 58. The port plate 76 has a first fluid flow port 78 and a second fluid flow port 80, with the first flow port 78 and the second flow port 80 connected to the pump suction port 82 and the pump discharge port 84. The suction port 82 and the discharge port 84 are defined according to conventional operation of the pump 18, in moving hydraulic fluid from the fluid reservoir 20 and into the hydraulic ram 26. The pistons 62, the cylinders 60 and the cylinder block 58 rotate with a pump drive shaft 56, with the outer ends of the pistons 62 engaging the swash plate 66 and the ported end of the cylinder block 58 engaging the port plate 76.

The swash plate 66 is mounted to a yoke or a cradle 68, preferably in fixed relation to the cradle 68, with the swash plate 66 and the cradle 68 pivotally secured within the motor housing 54 for angularly moving about an axis which is perpendicular to the longitudinal axis 90 of the drive shaft 56. A bias piston 70 is mounted in the pump housing 54 to provide a spring member, or bias means, which presses against one side of the cradle 68 and urges the swash plate 66 into position to provide a maximum fluid displacement for the pump 18 when the pump 18 is operated in conventional flow direction mode to pump the hydraulic fluid from the fluid reservoir 20 into the hydraulic ram 26. A control piston 72 is mounted in the pump housing 54 on an opposite side of the pump drive shaft 56 from the bias piston 70 for pushing against the cradle 68 to move the cradle 68 and the swash plate 66 against the biasing force of the bias piston 70, minimizing fluid displacement for the pump 18, when the pump 18 operated in the conventional flow direction mode to pump the hydraulic fluid from the reservoir 20 into the hydraulic ram 26.

The swash plate 66 preferably has a planar face defining a plane 86 through which extends the central longitudinal axis 90 of the pump drive shaft 56. A centerline 88 defines a neutral position for the swash plate plane 86, with the centerline 88 is preferably defined for the pump 18 as being perpendicular to the longitudinal axis 90 of the drive shaft 56. When the swash plate 66 is disposed in the neutral position, the stroke length for the pistons 62 will be zero and the pump 18 will have zero displacement since the pistons 62 are not moving within the cylinder block 58, as the cylinder block 58 is rotating with the drive shaft longitudinal axis 90. When the swash plate 66 is in the zero stroke position, with an angle C between the swash plate plane 86 and the centerline 88 equal to zero, the pump 18 is said to be operating at center and fluid will not be moved. The angle C between the centerline 88 and the plane 80 of the swash plate 66 determines the displacement for the pump 18. Stroking the control piston moves the cradle 68 and the swash plate 66 from the neutral position, in which the plane 86 the swash plate 66 is aligned with the centerline 88, to a position in which the angle C is greater than zero for operating the pump 18 in the conventional flow mode to provide hydraulic fluid to the ram 26. The larger the angle C relative to the centerline 88, the larger the displacement of the pump 18 and the larger the volume of fluid moved by the pump 18 for a given speed and operating conditions.

If the plane 86 of the swash plate 66 is moved across the centerline 88 to an angle D, the pump swash plate 66 is defined herein to have moved across center for operating the pump 18 over center as a hydraulic motor in the reverse flow mode. When the swash plate 66 is moved across center, the pump 18 will no longer move fluid from the fluid reservoir 20 to the hydraulic ram 26, but instead will move the hydraulic fluid in the reverse flow direction, from the hydraulic ram 26 to the fluid reservoir 20, for the same angular direction of rotation of the pump drive shaft 56 and the rotor for the electric motor 16 as that for pumping hydraulic fluid into the hydraulic ram 26. With fluid flow through the pump 18 reversed, the pressure of the hydraulic fluid in the hydraulic ram 26 may be released to turn the pump 18 into a hydraulic motor, which applies mechanical power to the AC electric motor 16. The load or weight of the piston rod 42, the traveling block 28, the belt 30 and the sucker rods 10 provide potential energy created by being lifted with hydraulic pressure applied to the hydraulic ram 26. The potential energy may be recaptured by passing the hydraulic fluid from the ram 26 through the hydraulic pump 18, with the swash plate 66 disposed over center such that the pump 18 acts as a hydraulic motor to apply power to the electric motor 16. The control unit 24 positions the swash plate 66 at the angle D from the centerline 88, such that the hydraulic pump 18 powers the electric motor 16 to run above synchronous speeds and generate electric power for applying to the meter 22 and passing into the power grid. With the energy previously stored as the potential energy of the weight of the lifted sucker rods 10, the carrier bar 32, the nylon belt 30 and the traveling block 28 recovered and applied to the meter 22 and the power grid, the only the energy used in operating the hybrid hydraulic-electric ram pumping unit 12 is that for lifting well fluids from the well, for friction losses and for efficiency losses.

In operation, the hybrid hydraulic-electric pumping unit 12 is operated to return energy to the electric power grid, by operating a positive displacement hydraulic pump 12 over center on the downstroke of the hydraulic ram 26. The control unit 24 will analyze data from both the load on the traveling block 28, or the hydraulic ram 26, and from the position sensor 50 which indicates the position of the piston rod 42 in the ram 26, and adjusting the position of the swash plate 66 to control the motor displacement. This controls the rate of the oil metered from the hydraulic ram 26, thus controlling the down-stroke speed of the ram 26 and the pump 18, which provides a counterbalance for the weight of the sucker rod assembly 10. Increasing the displacement increases the speed and decreasing the displacement decreases the speed for the pump 18 and the electric motor 16. During up-stroke of the hydraulic ram 26, the electric motor 16 is operated to move the hydraulic fluid through the pump 18, from the suction port 82 to the discharge port 84 and to the ram 26. The up-stroke speed of the pump 18 is controlled manually or is controlled automatically by a microprocessor-based control unit 24. During the downstroke of the hydraulic ram 26. The pump 18 is stroked over center by moving the swash plate 66 over center, and the hydraulic fluid will flow from the ram 26 into the port 84, through the pump 18 and then out the port 82 and into the reservoir 20, with the pump 18 acting as a hydraulic motor to drive the electric motor 16, which provided power for the up-stroke. During the downstroke, the electric motor 16 will be driven at rotations speeds above synchronous speeds to generate power for placing back into the power grid.

The load on the piston rod 42 at various linear positions as measured by the linear position sensor 50 is also analyzed by the control unit 24 to automatically provide selected up-stroke and downstroke speeds, and acceleration and deceleration rates within each stroke, for optimum performance. Should the well begin to pump down, the up-stroke and the downstroke speeds may be adjusted to maintain a constant fluid level within the well. The control unit 24 monitors key data and provides warnings of impending failure, including automatically stopping the pump from operating before a catastrophic failure. The control unit 24 will preferably monitor only the linear position of the piston rod 42 and the load on the piston rod 42. The load on the piston rod 42, or the polished rod load for the sucker rods 10 at the well head 34, may be determined by measuring hydraulic pressure in the ram 26, or measured by use of a load cell, or load sensor, mounted to the piston rod 42, the traveling block 28, the belt 20 or the carrier bar 32, and the like. Sensors may optionally be provided to allow the control unit 24 to also monitor the speed of the pump drive shaft and the rotor for the electric motor, and the input and output voltage and current for the electric motor.

The hydraulic pump 18 is a variable displacement pump which is commercially available and requires modification for operation according to the present invention. Pump 18 is commercially available from Yuken Kogyo Co., Ltd. of Kanagawa, Japan, such as the Yuken model A series pumps. Other commercially available pumps may be modified for operating over center, in the reverse flow direction, such as the Gold Cup series pumps available from Parker Hannifin HPD, formerly Denison Hydraulics, Inc., of Marysville, Ohio, USA, which uses a hydraulic vane chamber actuator for position a swash plate rather than the control piston of the Yuken model A series pump. The hydraulic vane chamber is preferably powered by a smaller hydraulic control pump connected to the drive shaft of the pump 18, rather than being powered by the pump 18. Hydraulic fluid is passed on either side of a moveable vane disposed in the vane chamber to move the vane within the chamber, and the vane is mechanically linked to a swash plate to move to swash plate to a desired position. In other embodiments, other type of actuators may be used to control the position of a swash plate relative to the centerline, such as pneumatic controls, electric switching, electric servomotor, and the like. The modifications for the pumps required for enabling operation according to the present invention are directed toward enabling the swash plates for the respective pumps to move over center, that is over the centerline, so that the pump may be operated over center in the review flow direction mode. The commercially available pumps were designed for use without the respective swash plates going over center, that is, they were designed and manufactured for operating in conventional flow direction modes and not for switching during use to operate in the reverse flow direction mode. Typical modifications include shortening sleeves for control pistons and power pistons, and the like. Internal hydraulic speed controls are also typically bypassed to allow operation over center. For the Denison Gold Cup series pumps, pump control manifolds may be changed to use manifolds from other pumps to allow operation of the pump over center. Closed loop pumps and systems may also be used, with such pumps modified to operate over center, in the reverse flow direction.

Figure 3:
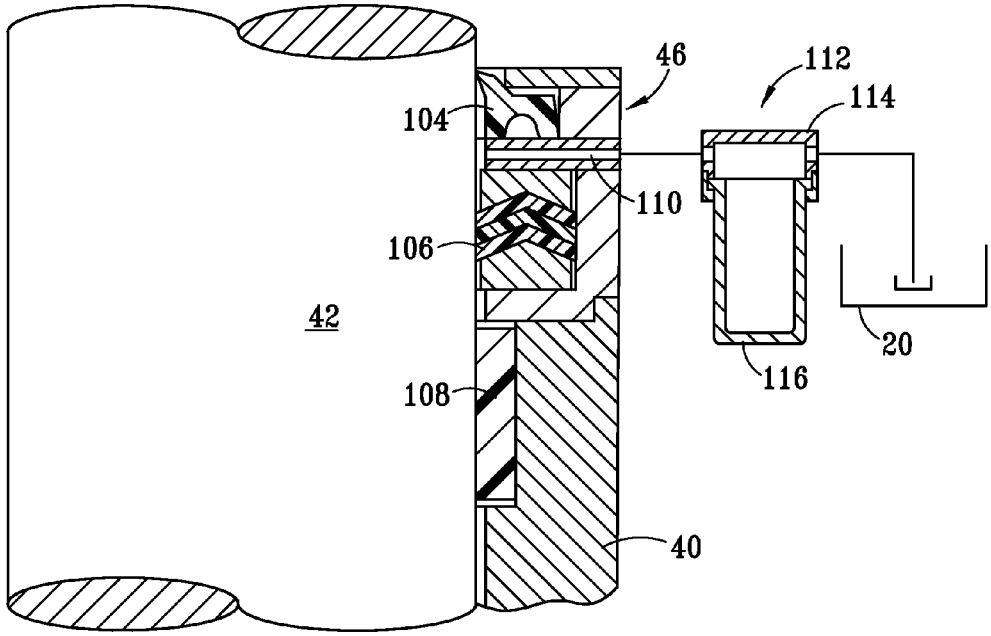

FIG. 3 is a one-quarter longitudinal section view of an upper portion of the cylinder 40 and the piston rod 42 for the hydraulic ram 26, showing the rod bearing and seal assembly 46 and a seal wear indicator 112. The seal wear indicator 112 provides an operator feedback in regard to the wear of seals in the rod bearing and seal assembly 46, and when the seals of the rod bearing and seal assembly 46 require replacement. The rod bearing and seal assembly 46 includes a wiper 104, a packing 106 and a sleeve bearing 108, each disposed in respective associated glands formed into the interior diametrical surface of a metal housing secured to the upper rend of the cylinder 40. A flow port 110 is provided to extend through the housing and into fluid communication with an annular space extending between the housing and the piston rod 42, between the wiper 104 and the packing 106. As the seals 106 wear, an increasing amount of hydraulic fluid will pass between the seal 106 and the piston rod 42, through the flow port 110, and through a flow line into an inlet port of the seal wear indicator 112. The seal wear indicator 112 has a metal manifold 114 and a sight chamber 116 which is removably secured to the manifold 114. Preferably, the sight chamber 116 is provided by a glass jar which is threadingly secured to the manifold 114. The seal wear indicator 112 has an outlet port which is connected directly to the reservoir fluid 20 to return any overflow of fluid from the seal wear indicator 112 to the reservoir 20. During normal operation, the sight chamber 116 may take an extended period of time to fill, during which time an operator may note the amount of the hydraulic fluid found in the sight chamber 116 and can unscrew or otherwise remove the sight chamber 116 from the manifold to empty into the reservoir 20 the captured hydraulic fluid leaked by the seal 106. As the seals 106 near the end of their useful life and require replacement, the sight chamber 116 will fill up much more frequently, which provides an indication to an operator that the seals 106 require replacement. In other embodiments, sensors may be provided which provide an electric signal indicating incremental amounts of hydraulic fluid which leaks past the seals 106, providing an indication or alarm signal indicating that the seals 106 should be replaced.

The hybrid hydraulic-electric pumping unit made according to the present invention provides advantages over the prior art. The pumping unit 12 comprises a single acting hydraulic ram 26, traveling block 28, belt 30, and a hydraulic power unit 18. During a downstroke, the pumping unit provides for regeneration and recapture of energy used during the upstroke. The sucker rod load is used during the downstroke to provide useable energy for placing back into the power grid, reducing costs for operating the pumping unit. The hydraulic pump which is used on the up-stroke a conventional flow mode for moving pressurized hydraulic fluid into the hydraulic ram, is modified during operation for use in a reverse flow mode on the downstroke as a hydraulic motor for converting the potential energy from the sucker rod load into the electric motor. The electric motor is operated above synchronous speeds to generate power back into the meter and the power grid. Preferably, controls for the hydraulic pump are operated to determine the rate at which fluids flows from the ram and through the pump, such as by selectively positioning the swash plate to determine a counterbalance flow rate at which hydraulic fluid flows from the ram back into the pump and is returned to a reservoir. In other embodiments, valving may be utilized to control flow, or a combination of valving and pump controls.

Although the preferred embodiment has been described in detail, it should be understood that various changes, substitutions and alterations can be made therein without departing from the spirit and scope of the invention as defined by the appended claims.

What is claimed is:

1. A hydraulic pumping unit for removing well fluids from a well, comprising:

an electric motor;

a reservoir for a hydraulic fluid;

a variable volume piston pump having a drive shaft connected to said electric motor for powering said variable volume piston pump, said variable volume piston pump having a pump suction port connected to said reservoir and a pump discharge port;

a sucker rod assembly disposed in the well for removing the well fluids from the well;

a ram connected to said pump discharge port for receiving the hydraulic fluid from said variable volume piston pump and moving from a retracted position to an extended position, said ram disposed at and adapted for moving the sucker rod assembly in the well to a raised position when said ram is moved to the extended position;

said variable volume piston pump adapted for moving the hydraulic fluid from said reservoir and into said ram, and moving said ram to said extended position, and for passing the hydraulic fluid from said ram into said reservoir, wherein pressure in said ram from a weight of the sucker rod assembly moves the hydraulic fluid from said ram, through said variable volume piston pump and into said reservoir to power said variable volume piston pump to turn said electric motor; and a control unit adapted for controlling flow rates of the hydraulic fluid through said variable volume piston pump for moving said ram between said retracted and said extended positions, wherein, during normal operation:

said variable volume piston pump is powered by said electric motor to provide hydraulic fluid to said ram for extending said ram; and said variable volume piston pump is powered by hydraulic fluid from said ram so that resulting energy from said variable volume piston pump is primarily directed to turn said electric motor and generate electric power in retracting said ram.

2. The hydraulic pumping unit according to claim 1, wherein said variable volume piston pump further comprises:

a motor housing;

a drive shaft rotatably mounted in said motor housing;

a cylinder block mounted to said drive shaft for rotating with said drive shaft, said cylinder block having a plurality of cylinders formed therein, and a plurality of flow ports in fluid communication with said cylinders;

a plurality of pistons mounted in said cylinders formed into said cylinder block, wherein said pistons are moveable within said cylinders for pulling fluid into and pushing fluid out of said cylinders through said flow ports; and a port plate for engaging said cylinder block and passing the hydraulic fluid from said flow ports to a pump suction port and to a pump discharge port corresponding to angular positions of said cylinder block rotating with said drive shaft.

3. The hydraulic pumping unit according to claim 2, further comprising a swash plate adapted to engage said plurality of pistons and move said pistons within said cylinders in response to said cylinder block rotating with said drive shaft, wherein said swash plate urges said pistons to press the hydraulic fluid from within said cylinder block when said pistons are disposed in proximity to said pump suction port, and to draw hydraulic fluid into said cylinder block when said pistons are disposed in proximity to said pump suction port.

4. The hydraulic pumping unit according to claim 3, wherein said swash plate is pivotally mounted within said pump housing for angularly moving about an axis to vary lengths of stroke for said pistons within said cylinder block to determine displacements for said variable volume piston pump.

5. The hydraulic pumping unit according to claim 4, wherein said swash plate is angularly movable over a neutral, center line position to operate said variable volume piston pump in a reverse flow direction in which the hydraulic fluid passes through said pump discharge port, into said cylinder block, and then through said variable volume piston pump suction port to power said pump to drive said electric motor.

6. The hydraulic pumping unit according to claim 4, further comprising a control member mounted in said pump housing and adapted for angularly moving said swash plate about said axis.

7. The hydraulic pumping unit according to claim 6, wherein said control member comprises a control piston, and said control piston is actuated by the hydraulic fluid.

8. The hydraulic pumping unit according to claim 5, further comprising a bias member for urging said swash plate into a first angular position respective to said drive shaft.

9. The hydraulic pumping unit according to claim 5, wherein said neutral, centerline position for said swash plate is a plane of said swash plate for engaging said pistons disposed generally perpendicular to a longitudinal axis of said drive shaft about which said drive shaft rotates.

10. A hydraulic pumping unit for removing well fluids from a well, comprising:

an electric motor;

a reservoir for a hydraulic fluid;

a pump having a drive shaft, a cylinder block, a plurality of pistons, a swash plate and a port plate, with said drive shaft adapted to connect with said electric motor for powering said pump, said cylinder block mounted to said drive shaft for rotating with said drive shaft and engaging said port plate, said cylinder block adapted for movably receiving a plurality of pistons, with said pistons adapted for being moved by said swash plate to displace the hydraulic fluid within said cylinder block with rotation of said cylinder block and said drive shaft, and said port plate engaging said cylinder block for passing the hydraulic fluid between a pump suction port and a pump discharge port depending upon angular positions of said cylinder block relative to said port plate;

a sucker rod assembly disposed in the well for removing well fluids from the well;

a ram connected to said pump discharge port for receiving the hydraulic fluid from said pump and moving from a retracted position to an extended position, said ram disposed at a wellhead and adapted for moving the sucker rod assembly in the well to a raised position when said ram is moved to the extended position;

said pump adapted for moving the hydraulic fluid from said reservoir and into said ram, and moving said ram to said extended position, and for passing the hydraulic fluid from said ram into said reservoir, wherein pressure in said ram from a weight of the sucker rod assembly moves the hydraulic fluid from said ram, through said pump and into said reservoir to power said pump to turn said electric motor; and a control unit adapted for controlling flow rates of the hydraulic fluid through said pump for moving said ram between said retracted and said extended positions, wherein, during normal operation:

said pump is powered by said electric motor to provide hydraulic fluid to said ram for extending said ram; and said pump is powered by hydraulic fluid from said ram so that resulting energy from said pump is primarily directed to turn said electric motor and generate electric power in retracting said ram.

11. The hydraulic pumping unit according to claim 10, wherein said swash plate is pivotally mounted within said pump housing for angularly moving about an axis to vary lengths of stroke for said pistons within said cylinder block to determine displacements for said pump.

12. The hydraulic pumping unit according to claim 11, wherein said swash plate is angularly movable over a neutral, center line position to operate said pump in a reverse flow direction in which the hydraulic fluid passes through said pump discharge port, into said cylinder block, and then through said pump suction port to power said pump to drive said electric motor at speeds faster than synchronous speeds.

13. The hydraulic pumping unit according to claim 12, further comprising a control member mounted in said pump housing and adapted for angularly moving said swash plate about said axis.

14. The hydraulic pumping unit according to claim 13, wherein said control member comprises a control piston, and said control piston is actuated by the hydraulic fluid.

15. The hydraulic pumping unit according to claim 14, further comprising a bias member for urging said swash plate into a first angular position respective to said drive shaft.

16. The hydraulic pumping unit according to claim 15, wherein said neutral, centerline position for said swash plate is a plane of said swash plate for engaging said pistons disposed generally perpendicular to a longitudinal axis of said drive shaft about which said drive shaft rotates.

17. A method for operating a pumping unit, comprising the steps of:

providing a ram, a traveling block and a sucker rod assembly, wherein the sucker rod assembly, the traveling block and the ram are located at a wellhead and configured for lifting well fluids from within a well, further providing a control unit, an electric motor, a variable volume piston pump and a reservoir for a hydraulic fluid, wherein the control unit, the electric motor, the reservoir and the variable volume piston pump are configured for moving the hydraulic fluid between the reservoir into the hydraulic ram for lifting and lowering the sucker rod assembly;

during normal operation:

applying electric power to the electric motor to power a variable volume piston pump to move the hydraulic fluid from the reservoir into the ram, lifting the traveling block and the sucker rod assembly;

releasing the hydraulic fluid from the ram into the variable volume piston pump and to the reservoir, and thereby providing mechanical power that is primarily directed to turning the electric motor;

controlling the flow of the hydraulic fluid from the ram, through the variable volume piston pump and into the reservoir to power the electric motor above synchronous speeds and generate recovered electric power; and applying the recovered electric power to a power source for the electric motor, wherein the recovered electric power is at least in part provided by potential energy stored in the sucker rod assembly when disposed in a lifted position.

18. The method for operating a pumping unit according to claim 17, wherein:

the step of providing the variable volume piston pump further comprising providing the variable volume piston pump with a cylinder block, a plurality of pistons and a swash plate, wherein the cylinder block rotates with a drive shaft and the pistons engage the swash plate to move within the cylinder block and displace fluid within the cylinder block, wherein the swash plate is moved to determine stroke lengths for the pistons and the displacement of the variable volume piston pump; and the step of controlling the flow of hydraulic fluid from the ram further comprising moving the swash plate to determine a displacement for the variable volume piston pump.

19. The method for operating a pumping unit according to claim 18, wherein the step of releasing the hydraulic fluid from the ram further comprises moving the swash plate over a neutral, center line position to operate the variable volume piston pump in a reverse flow direction, in which the hydraulic fluid flows from the ram, through the variable volume piston pump discharge port, through the pump, from the pump suction port and into the reservoir.

20. The method for operating a pumping unit according to claim 19, wherein the step of controlling the flow of the hydraulic fluid from the ram further comprises maintaining a load of the sucker rod assembly on the traveling block as the sucker rod assembly is moved to a downward position.

* * * * *